United States Patent [19]

Herzog

[11] 4,122,698

[45] Oct. 31, 1978

[54] ARRANGEMENT FOR AIR COOLING ON DRAWING DIE DRUMS

[75] Inventor: Günter Herzog, Hemer-Deilinghofen, Fed. Rep. of Germany

[73] Assignee: Ernst Koch & Co., Hemer-Ihmert, Fed. Rep. of Germany

[21] Appl. No.: 772,006

[22] Filed: Feb. 25, 1977

[30] Foreign Application Priority Data

Jun. 23, 1976 [DE] Fed. Rep. of Germany ..... 2628173

[51] Int. Cl.[2] ..... B21C 9/00; B21C 1/02

[52] U.S. Cl. ..... 72/286; 72/289

[58] Field of Search ..... 72/286, 289

[56] References Cited

U.S. PATENT DOCUMENTS

| | | | |
|---|---|---|---|
| 1,911,914 | 5/1933 | McIlvried | 72/289 |
| 3,064,798 | 11/1962 | Nye et al. | 72/286 |
| 3,130,832 | 4/1964 | Bruestle | 72/286 |

*Primary Examiner*—Michael J. Keenan

*Attorney, Agent, or Firm*—Martin A. Farber

[57] ABSTRACT

An arrangement for air cooling on drawing die drums, by which the drawing die drum, covered by a protective screen, with one end of the drum under formation of an air exit - annular gap is immersed in an annular chamber, the latter being connected with a source of cooling air. A tube section bridges across the space between the air exit - annular gap and the protective screen.

8 Claims, 3 Drawing Figures

ARRANGEMENT FOR AIR COOLING ON DRAWING DIE DRUMS

The present invention relates to an arrangement for air cooling on drawing die drums, by which the drawing die drum, covered by a protective screen, with one end of the drum, with formation of an air exit — annular gap is immersed in an annular chamber, the latter being connected with a source of cooling air.

With high-capacity or high-efficiency drawing machines, it is known to cool the drawing die drums from the inside with water and from the outside with air. The latter is achieved in the manner that the air is fed over an annular gap of approximately 4 mm in width, which annular gap is arranged at the level of the drawing die flange. This design is disadvantageous in the small utilization of the air, since the latter after leaving the annular gap and striking the drawing die drum is reflected away from the latter. In this manner the operating or service personnel are considerably troubled by the air reflecting all the way around on all sides. Further there arises intensified wind noises, which can cause detriment to the health of the operating personnel.

It is an object of the present invention, particularly in addition to the objects and advantages which may be gathered from the specification and claims, to provide an arrangement of the introductory-mentioned type for air cooling on drawing die drums, having a simple construction and providing a higher cooling degree, of such type that trouble and annoyance to the operating personnel by reflecting air and intensified wind noise are extensively avoided.

It is another object of the present invention, to aid in the solution of the above-mentioned object, by a tube section spanning or bridging over the spacing between the air exiting — annular gap and the protective screen.

As a consequence of such formation in accordance with the present invention, an arrangement for the air cooling on drawing die drums of the introductory mentioned type is produced of increases service value. The tube section in cooperative connection with the outer wall of the drawing die drum forms an annular chamber in communicating connection to the air exit — annular gap. In this manner the air leaving the annular gap is forced to pass through this chamber, with attaining of an increased cooling effect. The air which is reflected from the drawing die drum cannot exit indiscriminately, but rather is always directed onto the jacket surface of the drawing die drum by means of the tube section surrounding the drawing die drum. Also, the tube section surrounding the drawing die drum effects a directed air removal. The operating personnel in this manner are not bothered. The wind noise occurring by the air cooling further may be held low, with the production of more advantageous operating conditions for the service personnel.

An advantageous embodiment in accordance with the present invention resides in that the tube section is constructed in the form of a truncated cone. The truncated cone is directed such that the base thereof faces toward the air exit — annular gap. Thereby, likewise, there exists a dependency on the shape of the drawing die drum. As a consequence of this frustoconical form, the air leaving the tube section undergoes no dispersion or scattering effect. In accordance with the invention, it is advantageous that the upper exit opening of the tube section opens on the entire surface. As a result of this, the construction of the arrangement in accordance with the present invention for the air cooling can be held simple with the obtaining of reduced production expenses. Nevertheless sufficient safety is guaranteed. A possible break in a wire can lead to no injury by wire ends striking all around.

An advantageous feature in accordance with the present invention resides in providing a gap in between the annular chamber wall and the lower end of the tube section, which lower end is provided with a flange. In this manner additionally still one obtains an injector action, by which air flowing in through the gap yet is drawn on for the cooling, with intensification of the cooling effect.

Furthermore it is advantageous in accordance with the present invention that the tube section is secured to the protective screen. By removing the protective screen or horizontal pivoting of the same, respectively, simultaneously the tube section surrounding the drawing die drum is withdrawn, which facilitates the handling of such machines.

Still further in accordance with the present invention, it is yet advantageous to equip the tube section with peripheral-sided wire passage-through or circulation openings. These are selected of such size so that no reduction in the cooling performance or efficiency occurs.

With the above and other objects and advantages in view, the present invention will become more clearly understood in connection with the following detailed description of a preferred embodiment, when considered with the accompanying drawings, of which:

Figure 1:
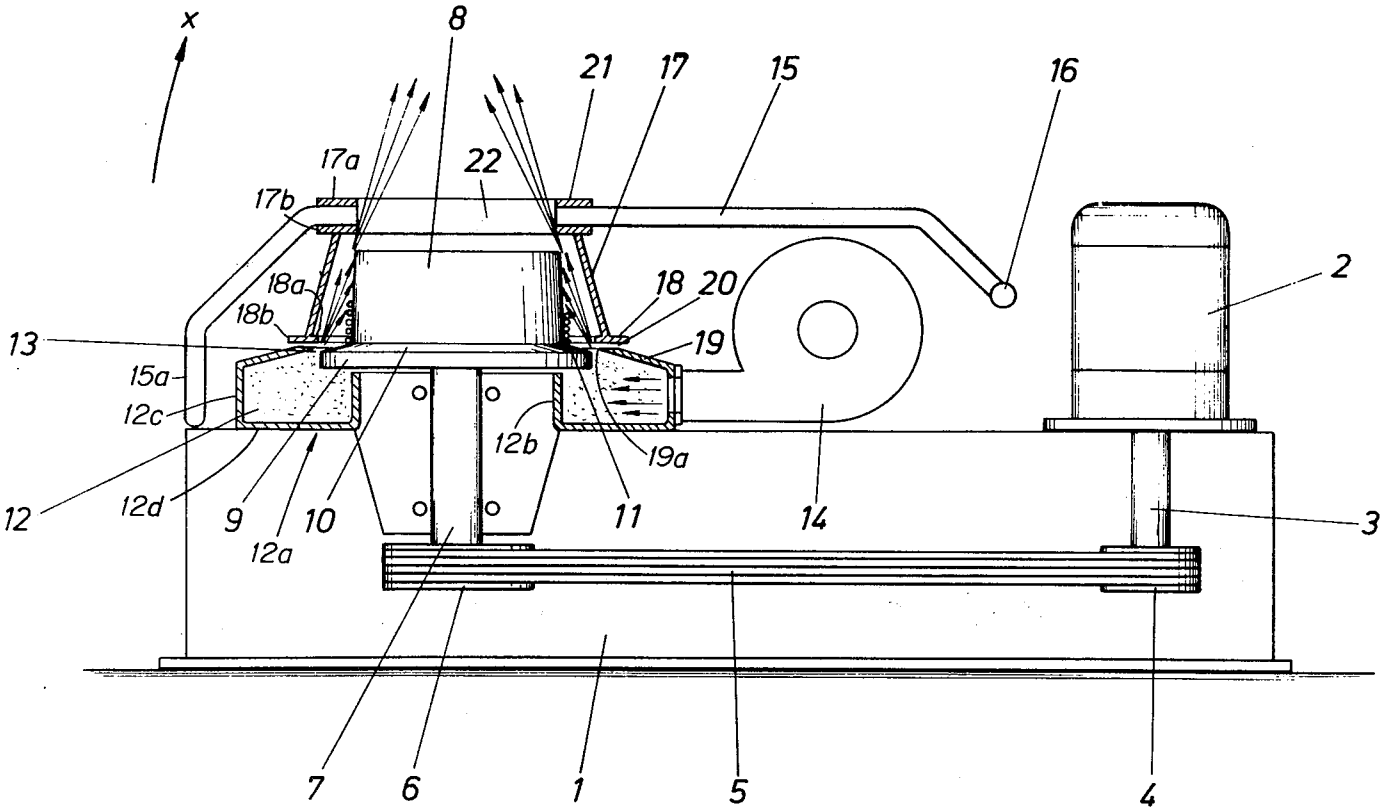
FIG. 1 is a schematic illustration of a partial cross-section through a high performance drawing machine with a protective screen disposed in the safety or secured position.
Figure 2:
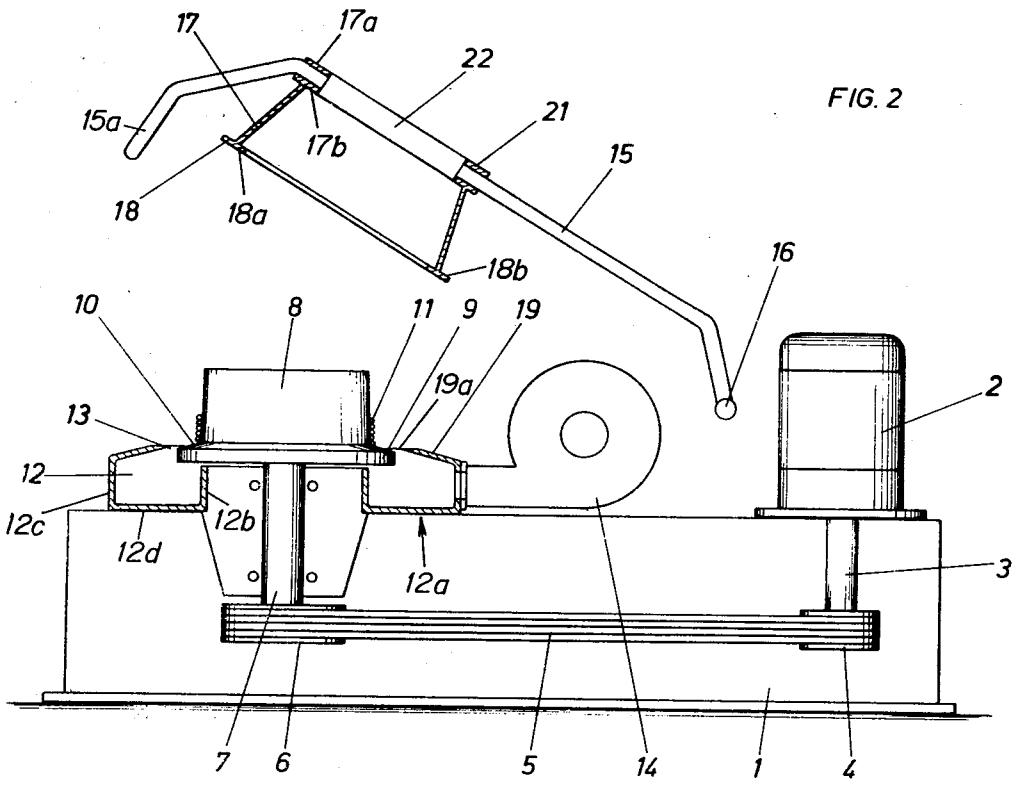
FIG. 2 is a section corresponding to FIG. 1, however with the protective screen swung into the release position.

Referring now to the drawings the high performance drawing machine in accordance with the present invention has a machine housing 1. The machine housing constitutes a carrier for the drive motor 2. A belt pulley 4 is mounted on the drive shaft 3 of the drive motor 2. A cone or V belt 5 is disposed about the belt pulley 4, which belt 5 in turn operatively places the belt pulley 6 in rotation. The belt pulley 6 is rigidly secured on a drive shaft 7 of the drawing die drum 8.

The drawing die drum is provided with a flange 9 and with a frustoconical contact surface 10 for the winding wire 11. The flange 9 projects in the opening of the annular chamber 12 which is disposed above the machine housing 1 and thereby forms an air exit removal — annular gap 13. The annular chamber 12 is formed by a member **12*a* having an inner wall 12*b* and an outer wall 12*c* substantially of the same height concentrically oriented and connected to each other at a bottom portion 12*d* thereof. The member 12*a* includes an inwardly extending annular chamber wall 19 connected to the top of the outer wall 12*c*. The annular chamber 12 stands in connection with a source of cooling air, which source is constructed in the embodiment example as a blower or ventilator 14**.

The ventilator 14, the drawing die drum 8 and the annular chamber 12 are covered by a protective screen 15. The protective screen 15 has a downwardly depending free end 15*a* covering and extending about one side of the tube section 17 to a level substantially lower than the annular gap 13. The protective screen 15 is swingably mounted about the axle 16 with respect to the housing, and indeed in the direction of the arrow x.

The distance or spacing between the air exit — annular gap 13 and the protective screen 15 is bridged over by a tube section 17. The tube section 17 is constructed in the form of a truncated cone such that the base of the cone points toward the annular gap 13. The upwardly inwardly extending annular chamber wall 19 has a free end 19*a* pointing to and adjacent to an upper portion of the flanged end of the drawing die drum and forming therewith the air exit — annular gap 13. The tube section 17 is formed with a flange 18 in the area of the base, which flange 18 in cooperative combination with the member 12*a* forming the annular chamber wall 19 of the annular chamber 12 leaves a gap 20 therebetween. The tube section 17 is formed with an annular flange 18 having radially inwardly and radially outwardly extending portions 18*a* and 18*b*, respectively, planarly aligned relative to one another. The radially inwardly extending portion 18*a* is disposed above the annular gap and is smaller than the radially outwardly extending portion 18*b*. The free end 19*a* of said annular chamber wall 19 is disposed spaced from and directly under the annular flange 18 overlapping the free end. The latter has an upper surface parallel to the annular flange and directed horizontally toward the upper portion of the flanged end of the drawing die drum 8.

The upper end 21 of the tube section 17 is secured on the other hand onto the protective screen 15. As evident from the drawing, an exit opening 22 of the tube section 17 opens on a complete surface.

The tube section 17 has an upper end formed with spaced annular flanges 17*a*, 17*b*. The protective screen 15 is secured to the tube section engagingly mounted between the spaced annular flanges.

Figure 3:
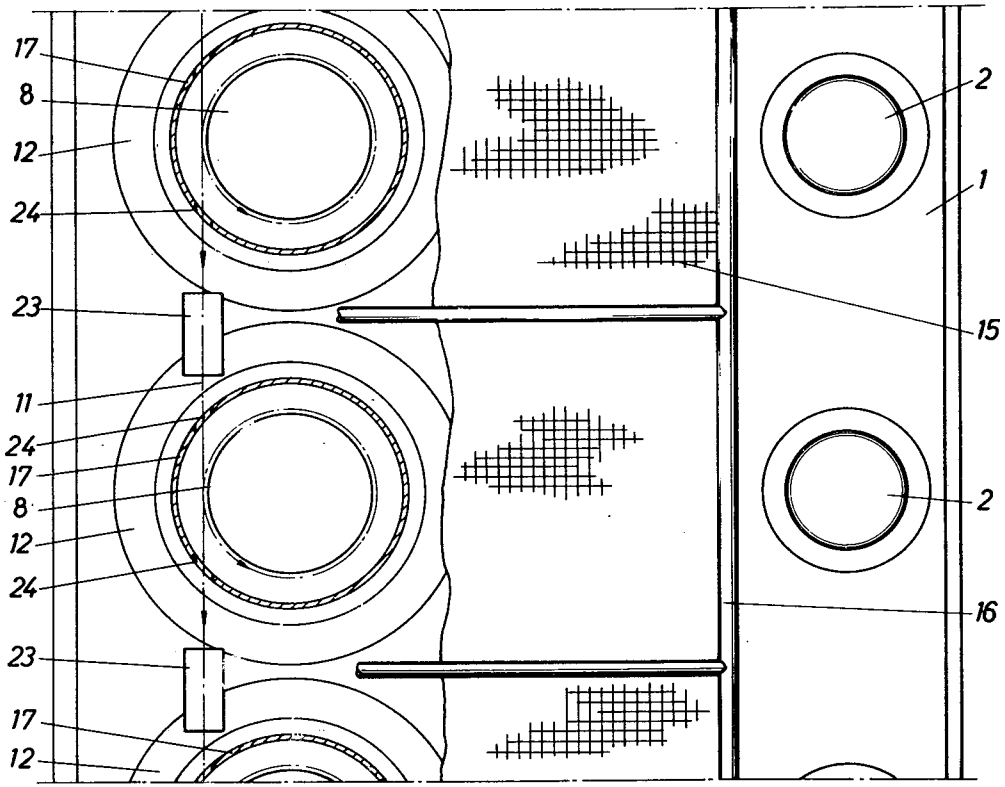
FIG. 3 is a plan view partially broken away of the high performance drawing machine of FIG. 1.

In accordance with the embodiment example, the machine housing 1 mounts a plurality of drawing die drums 8 disposed in a series or row one behind the other, which drawing die drums are respectively driven from one driving motor 2 each (FIG. 3). The wire 11 passes through the wire drawing dies 23 in the direction illustrated by the arrow. The tube section 17, which is formed of a pot-like sheet covering or lining, has wire passage openings 24 on its periphery in order to allow the wire to pass through without hindrance.

Starting from the position illustrated in FIG. 1, if the protective screen 15 is pivoted a small amount in the direction of the arrow *x*, the machine stops.

With the machine in operation, the ventilator or blower 14 forces the cooling air into the annular chamber 12. The cooling air exits through the annular gap 13 and is directed on the drawing die drum 8 and on the wire disposed on it, respectively, as indicated by the arrows. The tube section 17 which surrounds the drawing die drum 8 causes the air which reflects from the drawing die drum 8 to again be directed on the drum, with the achievement of an increased cooling effect. The gap 20 which is located between the flange 18 and the annular chamber wall 19, thereby yet permits a positive or certain injector action, so that additional air for cooling can come in through this gap 20. The cooling air exits from the upper exit opening 22 of the tube section 17 in the direction illustrated by the arrows and accordingly leads to less annoyance to the operating personnel. Likewise a dampening or reduction or the air noise is achieved by the tube section 17 surrounding the drawing die drum 8, improving the operating conditions on such high-capacity, heavy-duty drawing machines.

While I have disclosed one embodiment of the present invention it is to be understood that this embodiment is given by example only and not in a limiting sense.

I claim:

1. An arrangement for air cooling on drawing die drums, comprising at least one drawing die drum, a member having an inner wall and an outer wall of substantially the same height concentrically oriented and connected to each other at a bottom portion thereof, said member including an upwardly inwardly extending annular chamber wall connected to the top of said outer wall, said walls defining an annular chamber connected with a source of cooling air, a pivotally mounted protective screen laterally covering said drawing die drum and forming an upper exit opening above the latter, said drawing die drum having a lower flanged end mounted above said inner wall and extending radially outwardly relative thereto extending into said annular chamber, said upwardly inwardly extending annular chamber wall having a free end pointing to and adjacent to an upper portion of said flanged end of said drawing die drum and forming therewith an air exit — annular gap, at least one tube section being mounted and secured on said protective screen operatively disposed concentrically around said drawing die drum and having the form of a downwardly widening truncated cone, said tube section spans across substantially the entire spacing between said air exit — annular gap and said protective screen.

2. The arrangement for air cooling of drawing die drums, as set forth in claim 1, wherein said tube section cooperatively with said screen defines said upper exit opening which is open on an entire surface.

3. The arrangement for the air cooling of drawing die drums, as set forth in claim 1, wherein said tube section has a lower end, said annular chamber wall and said lower end of said tube section are spaced from one another defining a gap therebetween.

4. The arrangement for air cooling of drawing die drums, as set forth in claim 1, wherein said tube section is formed with peripheral — sided wire passage openings.

5. The arrangement for air cooling of drawing die drums, as set forth in claim 1, wherein said tube section is formed with an annular flange having radially inwardly and radially outwardly extending portions planarly aligned relative to one another, said radially inwardly extending portion is disposed above said annular gap and is smaller than said radially outwardly extending portion, said free end of said annular chamber wall is disposed spaced from and directly under said annular flange of said tube section, said annular flange overlapping said free end, the latter having an upper surface parallel to said annular flange and directed horizontally toward said upper portion of said flanged end of said drawing die drum.

6. The arrangement for air cooling of drawing die drums, as set forth in claim 1, further comprising a plurality of said at least one drawing die drum, a plurality of said at least one tube section operatively disposed cooperating with said plurality of drawing die drums, respectively, said plurality of tube sections are all secured to said protective screen, the latter constituting a single screen.

7. The arrangement for air cooling of drawing die drums, as set forth in claim 1, wherein said tube section has an upper end formed with spaced annular flanges, said protective screen is secured to said tube section engagingly mounted between said spaced annular flanges.

8. The arrangement for air cooling of drawing die drums, as set forth in claim 1, wherein said protective screen has a downwardly depending free end covering and extending about one side of said tube section to a level substantially lower than said annular gap.

* * * * *